United States Patent [19]

Adams

[11] Patent Number: 5,018,562

[45] Date of Patent: May 28, 1991

[54] POWER TOOL FENCE SYSTEM

[76] Inventor: Phillip A. Adams, 2542 Tartan Dr., Santa Clara, Calif. 95051

[21] Appl. No.: 455,207

[22] Filed: Dec. 21, 1989

[51] Int. Cl.[5] ..... B27B 31/60

[52] U.S. Cl. ..... 144/253 R; 83/468; 83/468.2; 83/468.7; 83/437; 269/303; 269/315

[58] Field of Search ..... 144/253 R; 83/437, 438, 83/467.1, 468, 468.2, 468.4, 468.7, 474; 269/303, 304, 315; 33/626, 180 R, 185

[56] References Cited

U.S. PATENT DOCUMENTS

| | | | |
|---|---|---|---|
| 2,285,897 | 6/1942 | Campbell | 269/303 |
| 3,124,181 | 3/1964 | Clemans | 269/315 |
| 4,077,290 | 3/1978 | Hreha | 83/468.2 |
| 4,256,000 | 3/1981 | Seidel | 83/468.2 |
| 4,693,158 | 9/1987 | Price | 269/303 |
| 4,745,834 | 5/1988 | Neumann | 83/468 |
| 4,747,330 | 5/1988 | Carithers, Jr. | 83/468.7 |
| 4,871,156 | 10/1989 | Kozyrski et al. | 269/303 |

*Primary Examiner*—W. Donald Bray

*Attorney, Agent, or Firm*—Skjerven, Morrill, MacPherson, Franklin & Friel

[57] ABSTRACT

A woodworking fence includes a dovetail slot into which a stop block and a push fixture each having a dovetail protrusion are in slidable engagement. Operation of a thumbscrew extending through the stop block wedges the block protrusion into firm fixed engagement with the fence dovetail slot. A bottom section of the stop block is undercut to form a relieved space which prevents accumulation of chips resulting from a cutting operation. A workpiece is pushed into a cutter by the push fixture which slides along a work surface and is kept in alignment by the push fixture dovetail protrusion sliding in the fence slot. The push fixture is relieved away from the work surface to avoid damage to the push fixture as the cutting tool cuts the portion of the workpiece adjacent to the push fixture. An erasable polycarbonate strip is disposed on the fence and has a permanent arrow locating the center of the cutting tool, to assist in locating the workpieces and stop block.

14 Claims, 7 Drawing Sheets

POWER TOOL FENCE SYSTEM

RELATED APPLICATION

This application is related to that patent application entitled "Workpiece Joint-Forming Template System," filed on Sept. 8, 1989, by Phillip A. Adams (application Ser. No. 07/404,710), now U.S. Pat. No. 4,965,943, the disclosure of which is expressly incorporated herein by reference.

FIELD OF THE INVENTION

This invention relates generally to woodworking equipment and in particular to a fence system for precisely orienting and moving a workpiece along a fence on a work surface.

BACKGROUND OF THE INVENTION

Operations in which wood and other materials such as plastics are cut by a power tool require the workpiece to be precisely positioned relative to the cutting blade or bit of the power tool in order to achieve the desired results. This is especially true when the workpiece to be cut is to be mated with other pieces such as grooves made for dovetail and finger (or box) joints, generally made by a router type tool, or dado cuts for interlocking edges, generally made by a table saw.

It is occasionally necessary to stop a groove cut or through cut within a workpiece. When several of these cuts are to be made in parallel it is desirable to have a movable guide (such as a fence), which is tied to one reference axis but is movable along a second axis perpendicular to the first axis, and is marked with some type of reference mark to ensure uniformity of the length of the groove or cut.

A fence helps in making parallel cuts by helping to guide the workpiece through the cutting tool blade while one edge of the workpiece is maintained in abutting relationship with the fence. When a previously made reference mark on the fence is reached, the operator retraces his path or carefully removes the workpiece from the cutting tool and resets the fence for a new cut. When a reference mark is correctly used to locate the stopping point for several parallel cuts, the ends of the cuts stop at points which collectively form a line. If the cuts are not made uniformly, deviations from the normally straight line will be observed. In the prior art this happens often.

According to prior practice, a stop block has been used to help in stopping workpieces at a reference mark. A stop block is clamped, with a C-clamp, to a location on the fence or table surface to act as a physical stop corresponding to a reference mark. When the workpiece reaches the clamped stop block, the location of which has been set by the operator, the cut is complete. The operator then removes the workpiece and if necessary, readjusts the location of the stop block and/or fence for the next cut. When it is necessary to make several identical or nearly identical pieces with cuts of several different lengths, the operator may have to clamp and unclamp the stop block several times to provide the correct block location for those various cuts.

In the prior art, an inverted T-shaped slot has been provided in a fence to assist in attaching a stop block. A nut and bolt clamping arrangement has been used to hold and clamp the stop block in place at various locations along the fence as needed. Generally a large clearance is provided between the T-slot and any T-bolt or T-nut that is engaged in the slot for tightening. Because of this large clearance, every time the stop-block is moved there is a possibility of misaligning the stop block with the slot and face of the fence when the stop block is reclamped, when compared to its alignment at previously clamped locations. A great disadvantage is that it is time consuming and cumbersome to reposition the stop block with the degree of accuracy and repeatability that is required to fabricate complex joint structures.

When a stop block is clamped to the fence, it also rests on or leaves a very small gap between it and the working surface (table). As a result, chips which are generated by the cutting of the workpiece collect around the stop block. These chips tend to randomly lodge (or jam) in the corner between the fence and the workpiece facing the cutting tool. While a workpiece is being cut these chips randomly collect in this corner and tend to act as shims between the fence, the stop block, and the workpiece causing undesirable random discrepancy between workpieces, i.e. those cut "shimmed" verses those cut "un-shimmed".

Temporary marks or indicia made by an operator on a fence have been used to provide some degree of repeatability of cuts made by a cutting tool in cooperation with a fence. However, the disadvantage with this prior art is that there has been no permanent reference mark (or indicium) corresponding to the location of the cutting tool or means for easily locating a stop block adjacent to said strip. A lack of reference to the location of the cutting tool has often caused operators to run past their mark causing the workpiece or push fixture to be damaged by over cutting. This can also create an unsafe situation. When an operator is manually pushing the last portion of a workpiece through the cutting tool and he does not know precisely where the cutting tool is located, the possibly of injury to the operator is increased.

A pusher piece is often used to provide the operator with some degree of safety while pushing the workpiece through the cutting tool. However, when the location of the cutting tool is not precisely known and the pusher piece generally rests on the working surface (through which the cutting tool protrudes to make its cut), the pusher piece is often damaged as a result of the cutting tool cutting through the workpiece and into the pusher piece as it pushes the workpiece along. Cutting into the pusher piece is undesirable as it damages the pusher piece which may render it useless for future cuts.

It is occasionally necessary to hold workpieces vertically for an end cutting operation to produce dovetail or finger corner joints. A modified pusher piece has been used in the prior art to act as a fixture to hold the workpiece clamped vertically while it is moved past the cutting tool to form corner joints If these pieces are not held firmly and uniformly as they are guided along the fence or if they are not guided along the fence uniformly, faulty non-uniform non-repeatable cuts often result.

SUMMARY OF THE INVENTION

The present invention provides a system by which a tool operator, such as a woodworker, using a guide fixture slidably engaged and coupled to a fence in a dovetail slot can accurately and repeatedly make full or partial cuts, including grooves, in workpieces. Means are also provided so that chips from the workpiece, such as wood chips, will not cause a random shimming action between a stop block and a workpiece. A slidable push fixture in sliding engagement with the fence and configured to avoid being damaged by a cutting tool is also provided. This fence system is designed to move as a unit to provide the maximum flexibility. As an example, this fence system might be used with a "Workpiece Joint-Forming Template System" of the above mentioned related patent application. This system is designed primarily for use on a router table but can be used with any stationary power tool where a cutting blade protrudes out of a working surface i.e., a table saw.

The system is comprised of a fence having a vertical generally rectangular cross section with a flat face perpendicular to the table surface and a top surface parallel to the table surface. A dovetail slot is cut in the fence on its top surface along its medial longitudinal axis. In the preferred embodiment the fence is made of a stress relieved high density polyethylene to provide a lightweight, rigid, impact resistant, immune to moisture warpage, high tensile strength, and non-staining structure with a low coefficient of sliding friction.

The system includes a stop block, preferably made of stress relieved high density polyethylene, having an eccentrically located longitudinally extending dovetail protrusion is mated with the centered dovetail slot in the top of the fence. The stop block is so formed that when it is supported by the dovetail slot it has a portion extending over the side of the fence facing the cutting tool, and suspended in a spaced relationship to the working surface. A bevel and a small gap, of about 3/16 inches, are provided at the bottom of the stop block between the working surface and the bottom of the stop block so that chips from the material being cut do not collect and jam in the corner between the surfaces facing the cutting tool as cutting progresses, as occurs in the prior art.

A means for tightening and fixing the stop block in the slot, such as a nylon thumbscrew fitted in a vertical threaded screw hole in the stop block longitudinally and laterally centered in the top of said stop block and the dovetail protrusion of the stop block respectively extending into the dovetail slot of the fence and through the center of the dovetail protrusion, is provided. When the thumbscrew is tightened, the lateral inclined surfaces of the dovetail protrusion are forcibly engaged with the lateral inclined surfaces of the dovetail slot in an upward wedge action so as to hold the stop block perfectly centered and aligned to the slot with only minimal torquing of the screw. The centering action and alignment of the stop block are enhanced by using polyethylene, having high lubricity (low coefficient of friction), as the material of construction.

The upper portion of the side of the fence facing the cutting tool is cut with a shallow wide slot. The slot contains a thin reversed screen inlaid strip permanently marked with an arrow (an indicium). When properly oriented, the arrow identifies the location on the fence corresponding to the center of the cutting tool on the working surface. The inlaid strip, preferably formed from "velvet like" LEXAN polycarbonate, is easily marked with a marking implement including a pencil. Pencil marks (temporary indicia) are easily erased for repeated use. The tool operator marks the strip as needed for a particular cutting operation and can use the arrow, corresponding to the center of the cutting took, as a reference in measuring and marking the strip for future cuts.

In operation, the stop block may be located on the fence at any reference mark made on the fence by the operator. The stop block can be easily moved and repeatedly returned to its reference position (within the accuracy of the operator's means for marking and locating) so that various different length cuts can be made, as guided by reference marks made on said polycarbonate marking strip on the fence. The stop block can also serve to limit the travel of a vertical push fixture to prevent damage to fixture's outside rail.

The fence can be connected by bolts or nuts to support structures. Countersunk apertures pass through the fence from the side of the fence facing the cutting tool so that support bolts do not interfere with a workpiece sliding thereon. The hole pattern described in one embodiment corresponds to the "T-shaped recesses" of a support structure; e.g., Universal Precision Positioning Jig; U.S. Pat. No. 4,793,604, a.k.a. "Incra Jig". In another embodiment integral or separate tabs are provided at each end of the fence on the side of the fence away from the cutting tool which may be fixedly clamped to the fence and the working surface.

A push fixture may be provided in order to assist in making correctly aligned dovetail slots or block fingers in a workpiece, particularly pieces which need to be held vertically and moved across the cutting tool. This push fixture also has a dovetail protrusion which slidably engages the dovetail slot in the top of the fence so that workpieces in abuttment with or clamped to the push fixture are maintained sliding in a fixed relationship with the fence. The push feature is normally slid by hand pushing this fixture along the dovetail slot.

The centered dovetail slot in the top of the fence provides storage flexibility for the accessories of the fence system. Those accessories, the stop block and push fixture, can be stored in the fence slot by turning them 180° so that they are located on the side of the fence away from the cutting tool. In this way the incremental fence system can be used as a normal fence without misplacing or dropping the fence system accessories.

DETAILED DESCRIPTION OF A PREFERRED EMBODIMENT

In the description which follows like parts are marked similarly throughout the specification and drawings. The drawings are not necessarily to scale and in some instances proportions have been exaggerated in order to more clearly depict certain features of the invention.

Figure 1:
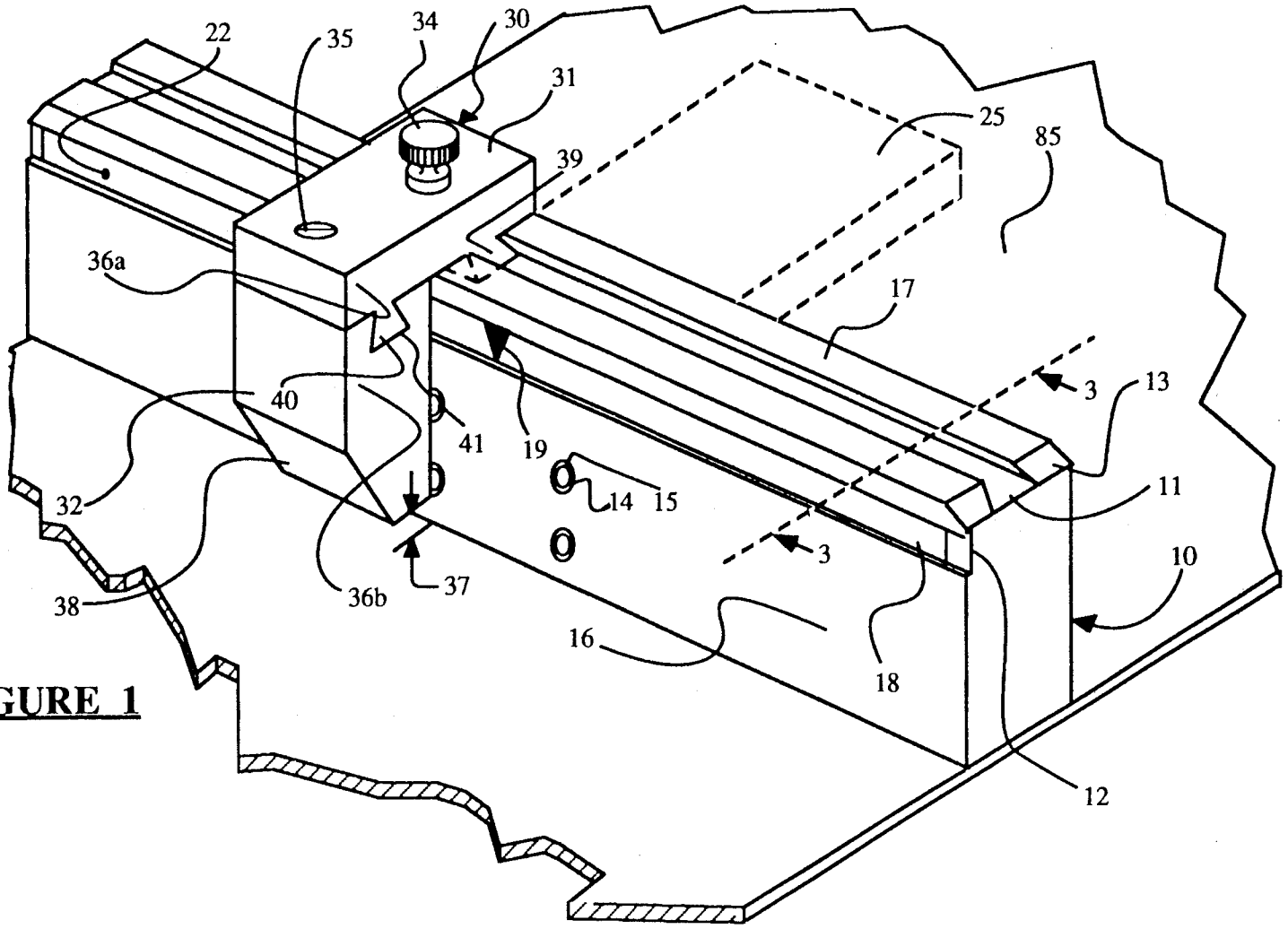
FIG. 1 is an isometric view of the fence and stop block of this invention positioned on a work table.
Figure 2A:
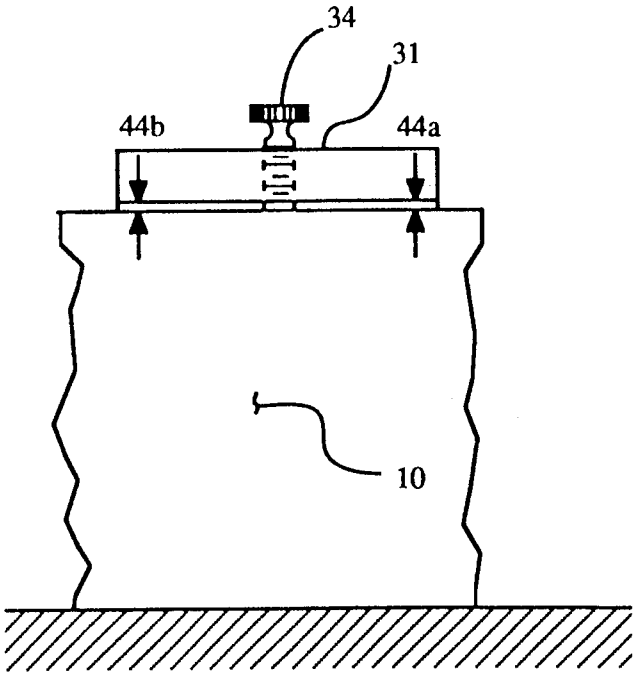
FIG. 2A shows a partial rear side view of the fence and stop block FIG. 1.
Figure 2:
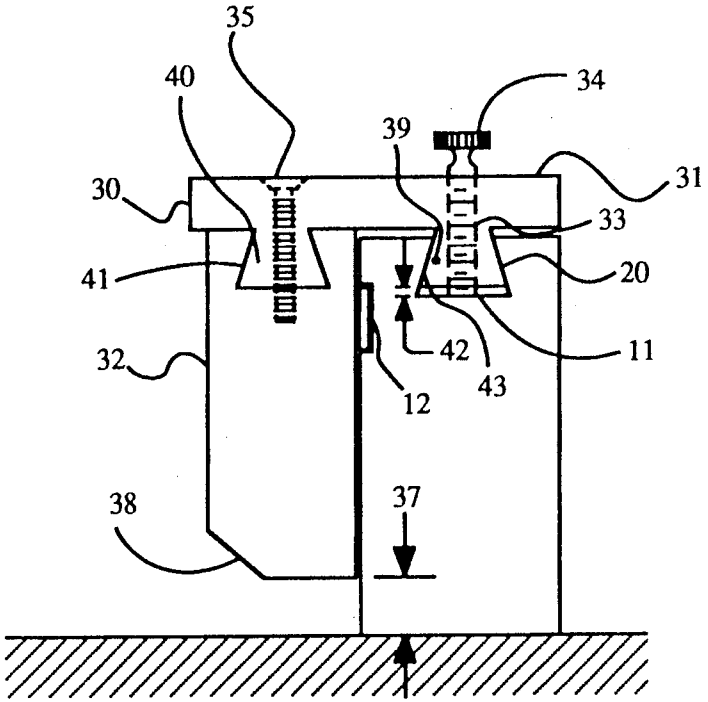
FIG. 2 is an end view of the fence and stop block.
Figure 3:
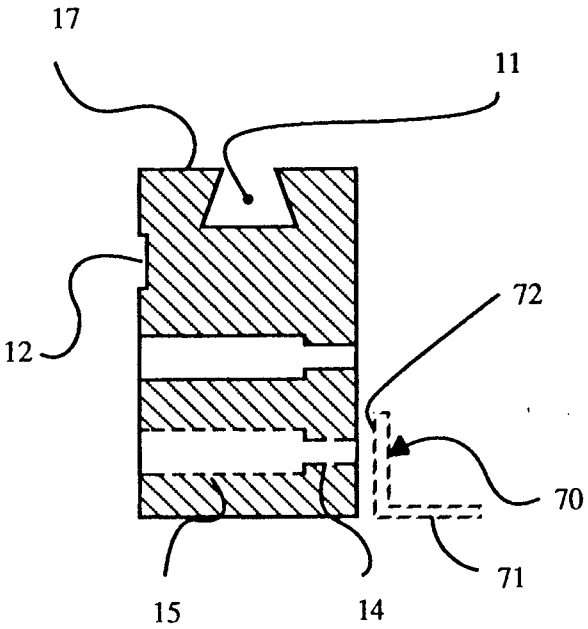
FIG. 3 is a cross sectional view of the fence taken on the line 3—3 of FIG. 1.

FIGS. 1, 2, and 3 show a fence 10, rectangular in cross section having a dovetail shaped slot 11 longitudinally cut and laterally centered in the top surface 17 of the fence. The top surface 17 has beveled ends 13 extending to the depth of the dovetail slot 11 enabling fixtures with dovetail protrusions to easily engage the slot.

The upper portion of the side 16 of the fence facing the cutting tool has a wide shallow side slot 12 for receiving a marking strip 18, preferably LEXAN-polycarbonate, therein. Location of the side slot 12 in the upper portion of the side of the fence provides better accessibility for marking than would a slot located further down the side of the fence.

Through holes 14 with widened countersunk bores 15 pass through the width of the fence. The pattern described by these holes matches the location of T-shaped recesses provided in an "Incra Jig" support structure 25 (U.S. Pat. No. 4,793,604) (outline shown in dashed lines) to hold and precisely position the fence according to a fixed reference, i.e., the "Incra Jig" is clamped to a work surface 85. The "Incra Jig" has two T-shaped recesses to hold the fence. The lower two holes of the four hole pattern on the fence shown, match the "Incra Jig" when it is fixed directly to a work surface on which the fence is used. The upper two holes of the fence match the location of the "Incra Jig" recesses when the "Incra Jig" is mounted on a support that is approximately ¾ inches thick, i.e., a ¾ inch thick piece of plywood, that is fixed firmly to the work surface.

Other methods for fixing the fence 10 to the work surface 85 include a pair of angle support tabs 70, one of which is pictured with dashed lines in FIG. 3. The upper legs 72 of tabs 70, which can be made of any structurally rigid material, are fastened to the ends of the back side of the fence 10 by bolting or clamping. The bottom legs 71 of the tabs 70 are then fixed to the working surface by bolting or clamping.

The fence 10 is approximately 1¼ inches in width, approximately 2⅞ inches in height, and approximately 16 inches in length; construed of stress relieved high density polyethylene for rigidity and lubricity. The dimensions of the fence may be varied as necessary to provide larger surfaces against which to guide workpieces as they are being cut and to span larger work surfaces using longer fences.

A stop block 30 as shown in FIGS. 1, 2, and 3 mates with the fence 10. The stop block 30 has a top horizontal section 31 and a side vertical section 32 both made of polyethylene. Two substantially parallel dovetail protrusions 39, 40 (second and first respectively) are provided in the bottom of the top section 31. The first dovetail protrusion 40 engages a dovetail slot 41 formed on the top edge of the side section 32. A screw connection 35 firmly connects the top section 31 and side section 32. The second dovetail protrusion 39 of the top section 31 is slidably positioned in the dovetail slot 11 of the fence 10. The width of the top section 31 is the same as the width of the side section 32 so that their collective front surfaces 36*a*, 36*b* form a uniform stopping surface against which workpieces of various heights can be uniformly stopped.

The side section 32 of the stop block 30 is about ¾ inches thick and sized so that when the stop block is engaged with the fence the side section 32 hangs down the face of the fence 10 on the side of the fence 16 facing the cutting tool. It has a bevel 38 at the bottom reducing its cross sectional area by approximately one half. A space 37 of approximately 3/16 to ¼ of an inch is provided between the bottom end of the side section 32 and the bottom of the fence which rests on the work surface. This space 37 and the bevel 38 allow cutting chips which might normally be caught between the bottom of a stop block and the work surface 85 and chips which might otherwise be caught in the corner between the stop block 30 and the fence 10 facing the cutting tool to escape. The bevel reduces the length of the path that chips flung at the stop block 30 from the cutting operation have to travel to move past the stop block 30. The gap 37 retards if not completely eliminates cutting chip buildup associated with a stop block on a fence and the introduction of random cutting errors associated therewith.

The second dovetail protrusion 39 from the bottom of the top section 31 is sized to fit with minimal clearance (about 0.005 inches) in the top slot 11 (FIG. 1) of the fence 10. A vertical threaded thumbscrew hole 33 passes through the top section 31 and this protrusion 39. This screw hole 33 is centered in the top section 31 along its longitudinal axis (same as the fence's longitudinal axis) as well as being centered in this second dovetail protrusion 39. A thumbscrew 34 made of nylon material is disposed in said thumbscrew hole 33. As the thumbscrew 34 is turned it exits the bottom of the second dovetail protrusion. The movement of the thumbscrew 34 out the bottom of the dovetail protrusion 39 causes the stop block 30 to be slightly lifted (the clearance distance 42) in the slot 11, forcing the dovetail protrusion 39 to a laterally central position in the slot 11. Further turning of the thumbscrew 34 easily firmly holds (clamps) the stop block 30 by upward wedge action at that location in the fence 10. FIG. 2 shows the stop block 30 in a clamped relationship with the fence 10, showing the lateral inclined surfaces 20, 43 of the dovetail slot 11 and dovetail protrusion 39 pressed together in a laterally centered relationship. FIG. 2A shows a substantially uniform gap 44*a*, 44*b* between the stop block top section 31 and fence top surface 17 which confirms longitudinal alignment. The substantially uniform gaps 44*a*, 44*b*, 12 (FIGS. 2, 2A) confirm longitudinal as well as lateral alignment showing that the stop block 30 is aligned to both fence 10 axes at any time when the stop block 30 is clamped to the fence 10 using the thumbscrew 34.

Repeated tightening of the thumbscrew 34 against the bottom of the top slot 11 in the fence 10 will not cause damage to either the end of the thumbscrew or the bottom of the slot as they are of substantially the same hardness, the thumbscrew 34 made of nylon and the bottom of the slot 11 (the fence 10) made of polyethylene. If these pieces were constructed of other materials any damage to these surfaces would have little effect on alignment of the stop block 30 in the fence 11 as the lateral surfaces 20, 43 of the slot and dovetail protrusion, important for precise alignment, would not be affected, as long as the screw end was not mechanically restricted from sliding while tightening.

A marking strip 18 (FIG. 1, 6, and 7) is normally disposed in the side slot 12 of the fence 10 to provide a way to easily mark, erase, and re-mark reference locations with a pencil (temporary indicia 22), or other equally erasable marking instrument, on the fence for use with or without a stop block. In the preferred embodiment, the marking strip 18 is made of a "velvet like finish" LEXAN polycarbonate—reversed screen inlaid strip permanently marked with an arrow 19 (permanent indicium) at approximately its center. It has a thickness of about 0.015 inches, a width equal to the width of the side slot 12 in the fence 10, and a length approximately 95% of the length of the fence 10. An adhesive is provided on the back of the marking strip 18 so that the marking strip 18 can be removed and its position adjusted as necessary to locate its arrow 19 at a position on the fence 10 corresponding to the center of the cutting tool adjacent to said fence 10.

Figure 4:
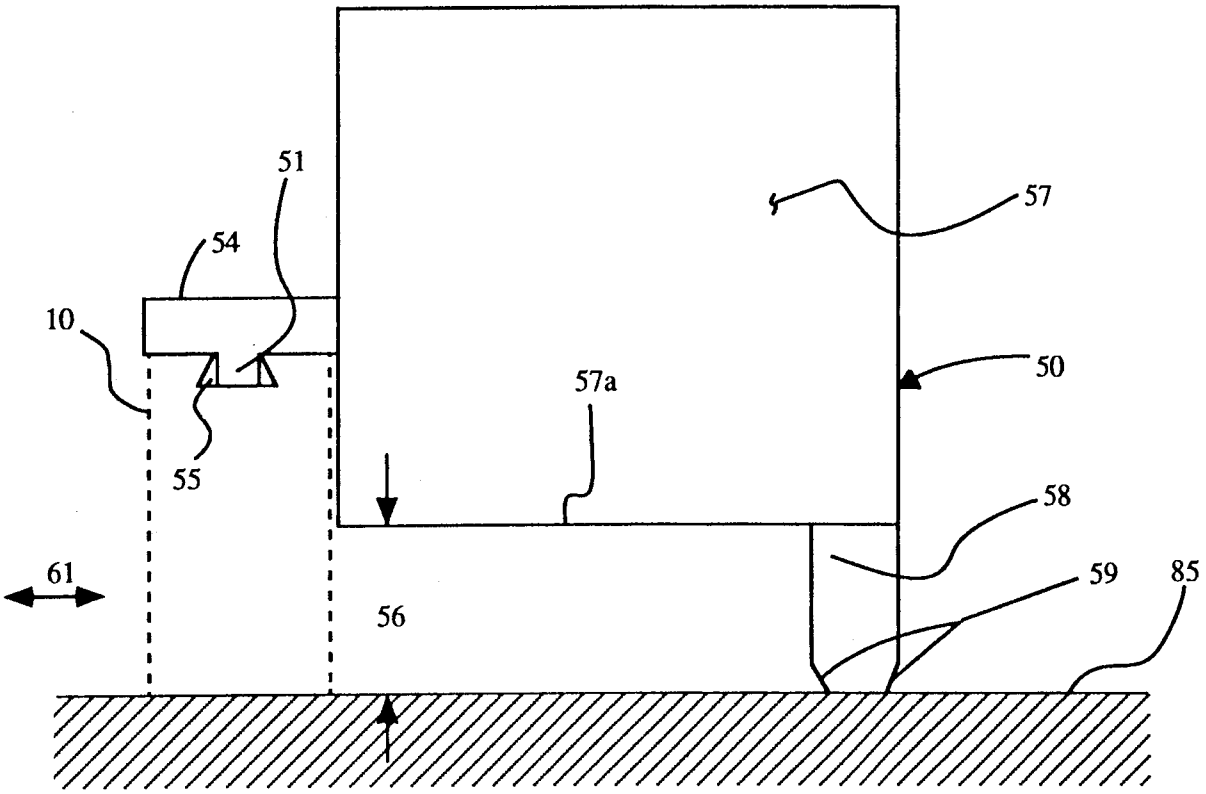
FIG. 4 shows a front view of the push fixture with the fence in phantom lines.
Figure 5:
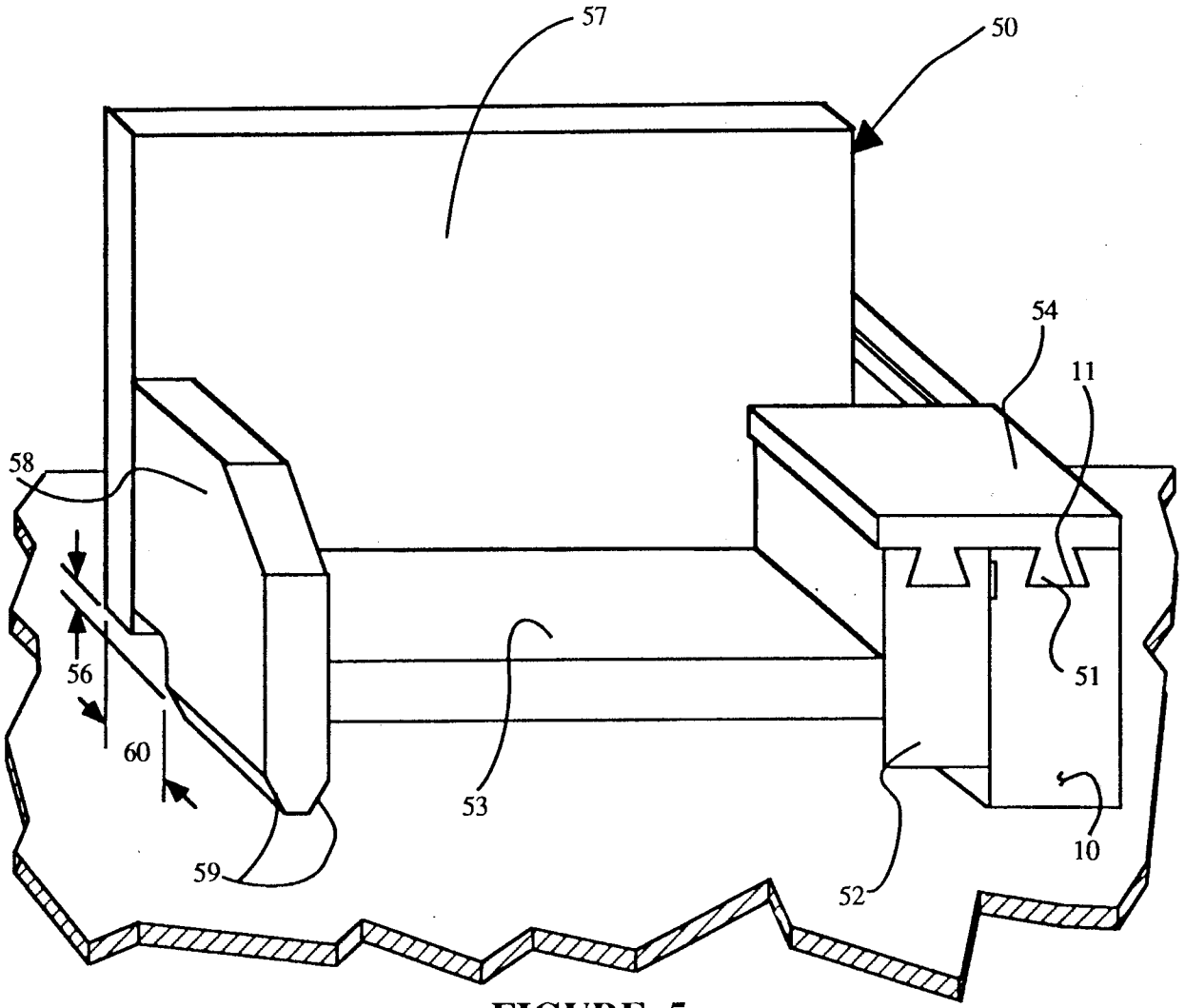
FIG. 5 shows an isometric rear view of the push piece engaged with the fence.

FIGS. 4 and 5 show a push fixture 50 for holding a workpiece vertical to the work surface 85 as the workpiece is moved past the cutting tool as guided by the fence 10. The push fixture 50 is interlocked with the top slot 11 of the fence 10 by a push fixture dovetail protrusion 51. The push fixture 50 is constructed of various parts, in the preferred embodiment all made of stress relieved-high density polyethylene. This material when sliding on itself, i.e., the push fixture 50 sliding on the fence 10, provides lubricity between sliding surfaces. The resulting very low coefficient of friction reduces the force necessary to slide closely fitting connecting pieces. This material is also lightweight, impact resistant, immune to warpage as a result of moisture, has a high tensile strength, and is non-staining and is therefore ideally suited for use in this system.

FIG. 4 shows a front view of the push fixture 50 on the worksurface 85 as oriented with a fence 10 shown with dashed lines. FIG. 5 shows the push fixture 50 from the back as it would be observed in use when attached to the fence 10. The push fixture 50 is constructed of a push fixture mating section 54 which has a dovetail protrusion 51 which mates relatively tightly with, but slidable in, the dovetail slot 11 in the fence 10. The push fixture mating section 54 connects to a side section 52 adjacent to fence which connects to a vertical section 57 at the front of the push fixture 50. The part of the vertical section 57 away from the fence is supported from the working surface 85 by an outside rail 58. A push fixture web 53 provides additional structural integrity to the push fixture 50.

The push section dovetail protrusion 51 interlocks relatively tightly with the dovetail top slot 11 in the fence 10. The leading corners of the lateral portion of the dovetail protrusion are relieved 55 to make it easier for the tightly fitting push fixture 50 to engage the dovetail top slot 11 in the fence 10.

The push fixture 50 is used to hold a workpiece clamped (including one held-by-hand) to the vertical section 57 to hold the workpiece perpendicular to the work surface 85, and perpendicular to the longitudinal axis of the fence 10 as the workpiece is slid with the push fixture 50 past a cutting tool. A workpiece held in this manner can be moved with the fence 10, when the fence 10 is moved a distance perpendicular 61 to its longitudinal axis to create several parallel cuts according to the dimension that the fence 10 is moved.

The outer rail 58 of the push fixture 50 has bevels 59 at the bottom, reducing the sliding surface area supporting the fixture. The front end of the rail 58 is relieved back 60 from the front edge of the vertical section 57 about ¾ of an inch (FIGS. 5 and 4). This is to avoid damaging the push fixture 50 when a cutting tool daylights through the workpiece right at the location of the outer rail 58. The vertical section 57 also is relieved at 56 from the working surface about one inch to prevent damage to the push fixture 50 when the cutting tool emerges from the workpiece in the gap 56 between the work surface 85 and the bottom of the push fixture vertical section 57*a*.

Figure 6:
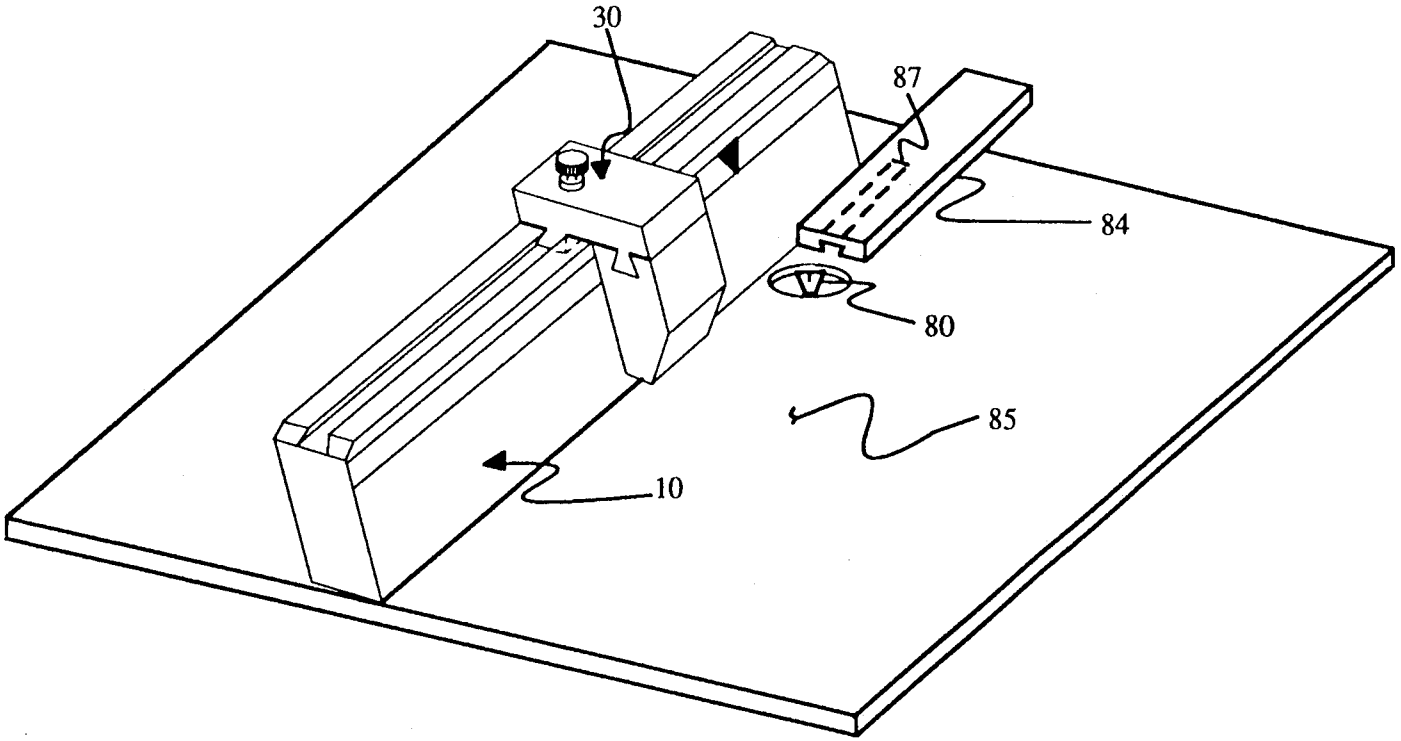
FIG. 6 shows the fence and stop block being used on a router table.

FIG. 6 shows a router type cutting tool 80 cutting a workpiece 84 on a work surface 85, as the workpiece 84 is guided along a fence 10 to a stop block 30 to make a groove 87 through part of the workpiece 84.

Figure 7:
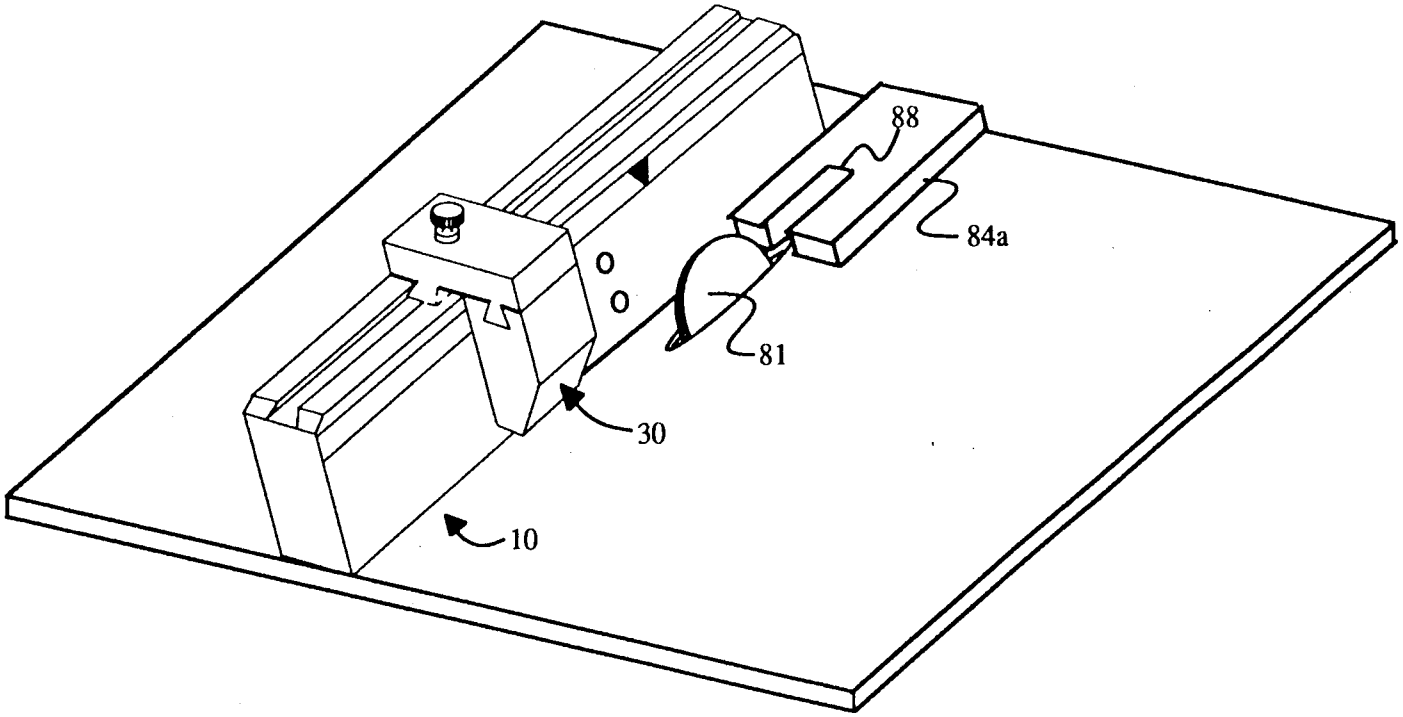
FIG. 7 shows the fence and stop block being used on a table saw.

FIG. 7 shows a circular saw type cutting tool 81 cutting a workpiece 84*a* on a work surface 85, as the workpiece 84*a* is guided along a fence 10 to a stop block 30 to make a slot 88 through part of the workpiece 84*a*.

The centered dovetail slot 11 in the top 17 of the fence 10 also provides storage flexibility for the accessories of the fence system. Because the top slot 11 is centered in the top of the fence 10 the dovetail protrusion of each accessory can be placed in the top slot 11 when located on either side of the fence 10. Therefore fence accessories, the stop block 30 and push fixture 50, can be stored in the fence slot 11 while their appendages are located on the side of the fence away from the cutting tool and the fence can be used as a normal fence without misplacing (losing) the fence system accessories.

The above description of embodiments of this invention is intended to be illustrative and not limiting. Other embodiments of this invention will be obvious to those skilled in the art in view of the above disclosure.

I claim:

1. A power tool fence system for orienting a workpiece in a predetermined position relative to a cutting tool protruding through a work surface comprising:

a rigid fence having a dovetail longitudinal slot having divergent side edges defined therein and having a first side facing said cutting tool against which the workpiece can be placed;

an adjustable stop block having an integral longitudinal dovetail protrusion, said protrusion being operatively coupled with said fence by engagement with said dovetail slot in said fence; and means extending through said block to a bottom of said dovetail slot for raising said dovetail integral protrusion against said side edges of said dovetail slot and for locating said protrusion with respect to said dovetail slot of said fence thereby preventing the travel of the workpiece along said fence beyond said stop block.

2. A power tool fence system as in claim 1, wherein said fence and stop block are constructed of polyethylene.

3. A power tool fence system as in claim 2, wherein said polyethylene is high density polyethylene.

4. A power tool fence system as in claim 2, wherein said polyethylene is stress relieved.

5. A power tool fence system as for orienting a workpiece in predetermined position relative to a cutting tool protruding through a work surface comprising:

a rigid fence having a dovetail slot defined therein and having a first side facing said cutting tool against which the workpiece can be placed;

an adjustable stop block having a dovetail protrusion, said protrusion being operatively coupled with said fence by engagement with said dovetail slot in said fence;

means extending through said block for tightening said dovetail protrusion in said stop block and for locating said protrusion with respect to said dovetail slot of said fence thereby preventing the travel of the workpiece along said fence beyond said stop block;

wherein said fence first side has a shallow slot; and further comprising:

an erasable strip of medium for recording temporary indicia thereon disposed in said shallow slot of said first side of said fence, said strip having a permanent indicium thereon correlating to the location of the cutting tool adjacent thereto, such that movement of said stop block in said fence to a temporary or permanent indicium or between temporary and/or permanent indicia provides a means for temporarily and repeatedly precisely locating the stop block according to said indicium or said indicia, further such that when a first set of temporary indicia are removed only the permanent indicium remains.

6. A power tool fence system as in claim 1 wherein a bottom portion of the adjustable stop block adjacent to said fence extends to a position above the work surface such that chips from cutting said workpiece exit from underneath said block so as not to jam against said fence.

7. A power tool fence system for orienting and/or maintaining a workpiece in a predetermined position relative to a cutting tool protruding through a working surface comprising:

a laterally movable fence having an outer longitudinal dovetail slot defined therein located along its length and a first side facing said cutting tool against which the workpiece can be placed; and an adjustable push block for moving the workpiece and having a side extension including a longitudinal integral dovetail protrusion operatively coupled with said fence by said dovetail protrusion engaging and being slidable in said dovetail slot of said fence for linearly guiding said push block.

8. A power tool fence system for orienting and/or maintaining a workpiece in a predetermined position relative to a cutting tool protruding through a working surface comprising:

a fence having a longitudinal dovetail slot defined therein located along its length and a first side facing said cutting tool against which the workpiece can be placed; and an adjustable push block and having a side extension including a dovetail protrusion operatively coupled with said fence by said dovetail protrusion engaging said dovetail slot in said fence; and wherein said push block is constructed having a vertical surface which creates a 90 degree angle with the first side of said fence and a 90 degree angle with the work surface.

9. A power tool fence system for orienting and/or maintaining a workpiece in a predetermined position relative to a cutting tool protruding through a working surface comprising:

a fence having a longitudinal dovetail slot defined therein located along its length and a first side facing said cutting tool against which the workpiece can be placed; and an adjustable push block having a side extension including a dovetail protrusion operatively coupled with said fence by said dovetail protrusion engaging said dovetail slot in said fence;

wherein said pushblock includes an outside runner support; and wherein said vertical surface and said outside runner support are relieved away from said working surface so that the push block avoids contacting the cutting tool as said cutting tool is completing its cut through said workplace. through said workpiece.

10. A power tool fence system as in claim 9 wherein said push block dovetail protrusion is relieved partially at its ends to facilitate easier insertion of the dovetail protrusion of the push block into the dovetail slot of the fence.

11. A power tool fence system as in claim 7 further comprising:

an adjustable stop block having a dovetail protrusion, said protrusion being operatively coupled with said fence by engagement in said dovetail slot downstream of the push block.

12. A power tool fence system for orienting a workpiece in a predetermined position relative to a cutting tool comprising:

a fence having a top side and a first side facing said cutting tool against which the workpiece can be placed;

a reference stop operatively coupled with said fence such that when said stop is fixedly located with respect to said fence it will limit the travel of the workpiece along said fence; and a plurality of indicia disposed on said fence along said first side of said fence such that movement of said stop between indicia provides a means for precisely locating and moving said workpiece in relation to said cutting tool in accordance with the movement of the stop between indicia.

13. A power tool fence system for orienting and or maintaining a workpiece in a predetermined position relative to a cutting tool comprising:

a fence having a top side, a first side facing said cutting tool against which the workpiece can be placed and having a shallow slot;

a reference stop operatively coupled with said fence along said top side such that when said stop is fixedly located adjacent to said first side of said fence it will limit the travel of the workpiece along said first side of said fence; and an erasable strip of medium for recording temporary indicia thereon disposed in said shallow slot of said first side of said fence, said strip having a permanent indicium thereon correlating to the location of the cutting tool adjacent thereof, such that movement of said stop block in said fence to an indicium or between indicia provides a means for temporarily and repeatedly precisely locating and moving said workpiece in relation to said cutting tool in accordance with the stop block disposed according to said indicium or said indicia, further such that when a first set of temporary indicia are removed only the permanent indicium remains.

14. A power tool fence system for orienting a workpiece in a predetermined position relative to a cutting tool protruding through a work surface comprising:

a rigid fence having a dovetail slot defined therein, said fence having a first side facing said cutting tool against which the workpiece can be placed;

an adjustable stop block having a dovetail protrusion, said protrusion being operatively coupled with said fence by engagement with said dovetail slot in said fence;

means extending through said block for tightening said dovetail protrusion in said stop block and for locating said protrusion with respect to said dovetail slot of said fence thereby preventing the travel of the workpiece along said fence beyond said stop block; and an adjustable push block having a side extension including a dovetail protrusion operatively coupled with said fence by said dovetail protrusion engaging said dovetail slot in said fence.

* * * * *